United States Patent [19]

Yasuda et al.

[11] Patent Number: 4,933,721

[45] Date of Patent: Jun. 12, 1990

[54] IMAGE FORMING APPARATUS WITH PRECONDITIONING EXPOSURE SELECTIVELY FORMING A MULTI-COLOR AND MONO-COLOR IMAGE

[75] Inventors: Kazuo Yasuda; Kumiko Izawa; Hiroshi Tokunaga, all of Hachioji, Japan

[73] Assignee: Konishirpku Photo Industry Co., Ltd., Tokyo, Japan

[21] Appl. No.: 177,586

[22] Filed: Apr. 4, 1988

[30] Foreign Application Priority Data

| | | | |
|---|---|---|---|
| Apr. 7, 1987 | [JP] | Japan | 62-85362 |
| Apr. 10, 1987 | [JP] | Japan | 62-88159 |
| Jan. 29, 1988 | [JP] | Japan | 63-19201 |

[51] Int. Cl.[5] ..... G03G 21/00

[52] U.S. Cl. ..... 355/210; 355/326

[58] Field of Search ..... 355/4, 3 CH, 14 CH, 355/14 E, 3 R, 208, 210, 214, 219, 326

[56] References Cited

U.S. PATENT DOCUMENTS

| | | | |
|---|---|---|---|
| 4,165,165 | 8/1979 | Iwami et al. | 355/4 |
| 4,621,920 | 11/1986 | Takahashi | 355/3 R |
| 4,679,929 | 7/1987 | Haneda et al. | 355/4 |

*Primary Examiner*—Joan H. Pendegrass

*Attorney, Agent, or Firm*—Jordan B. Bierman

[57] ABSTRACT

An image forming apparatus wherein in multi-color mode a multi-color image is formed by repeating a series of uniform charging, image exposing and developing steps to form a plurality of color toner image on a surface of an image retainer, and transferring the color toner image to a transfer material, and wherein in mono-color mode a mono-color image is formed by uniform charging, image exposing and developing in a single step to form a mono-color toner image on the surface of the image retainer, and transferring the mono-color toner image to a transfer material one of the modes being selected. The image retainer is exposed uniformly before the uniform charging step.

9 Claims, 7 Drawing Sheets

IMAGE FORMING APPARATUS WITH PRECONDITIONING EXPOSURE SELECTIVELY FORMING A MULTI-COLOR AND MONO-COLOR IMAGE

BACKGROUND OF THE INVENTION

1. Field of the Invention

The present invention relates to an image forming apparatus capable of selectively forming a multi-color image and a mono-color image.

2. Description of the Prior Art

In the image forming apparatus of this kind of the prior art such as a printer or a PPC reproducing machine, there is used as an image retainer a highly sensitive photosensitive member of selenium-tellurium or selenium-arsenic group, or an organic photosensitive member. However, the photosensitive member of this kind has an optical fatigue. Even after a latent image formed by a first image exposure has been developed, transferred and cleaned and then a uniform charging for forming a second latent image has been accomplished, the first latent image remains as a optical fatigue (a so-called "optical memory"). This causes a problem that a ghost image appears on a subsequent transfer paper, especially when a mono-color image formation adopts a demand system so as to shorten the time period for the image formation.

As a means for solving this problem, there is accomplished a so-called exposure before charging, in which the optical fatigue resulting from the previous image exposure is masked by effecting a uniform exposure before the uniform charging of the image retainer to give a uniform optical fatigue.

FIGS. 7A to 7C are diagrams for explaining changes in the surface potential of an image retainer. FIG. 7 A represents a case in which the exposure before charging is not accomplished. In FIG. 7A , letter (a) indicates the potential of the image exposure, the optical fatigue of which remains as a potential (b) even after a second uniform charging and as a potential (c) even after a third uniform charging. Where a demand system is adopted in a mono-color mode, a position in which a latent image is formed will shift when in a continuous reproducing operation so that the potentials (b) and (c) cause ghost images.

FIG. 7B represents a case of the exposure before charging and shows that the potentials (b) and (c) disappear.

FIG. 7C represents a case of the multi-color mode and shows that since the toner stays stuck until the toner image of a final color is formed on the image retainer, the potential is more smooth than when no toner sticks.

The hatching indicates that the potential is raised as a result of the stuck toner.

The exposure before charging can well exhibit its effect for the mono-color image formation to prevent a ghost image from being formed. In the case of the multi-color image formation, however, the toner image of a first color is subjected to an exposure before charging, when a latent image of a second color is to be formed after completion of the toner image of the first color. Therefore, the amount of exposure differs between the different portions of the image retainer surface, where the toner sticks and not. This causes a difference in the amounts of charge elimination and accordingly in the potentials. As a result, there arises a phenomenon that the charged toner is influenced by an electric field generated by the potential difference so that it scatters.

This discourages the exposure before charging from being used in the case of the multi-color formation, in which toner images of individual colors are to be transferred by one operation after they have been formed on the image retainer.

Here in the case of the multi-color image formation, the toner images are not transferred for each color but have their toners retained as they are. Upon formation of latent image of second or later colors, therefore, the potential of the surface of the image retainer is relatively smoothed, as shown in FIG. 7 C , by the action of a scorotron. As a result, the multi-color image forming apparatus is not usually equipped with means for exposing before charging.

It is, however, the current practice to give the multi-color image forming apparatus a mono-color image forming function. The mono-color image formation frequently adopts a demand system so as to shorten the time period for continuous reproductions.

This involves the aforementioned problem that the ghost image is liable to form. Irrespective of the demand system, there naturally arises the problem that the ghost image is formed even in the case a different image is formed by changing a document shortly after the end of the previous image formation.

SUMMARY OF THE INVENTION

In order to solve those problems, an object of the present invention is to provide an image forming apparatus which can prevent any toner from scattering in a multi-color image formation (i.e., in a multi-color mode) and any ghost image from being formed in a mono-color image formation (i.e., in a mono-color mode) and in the multi-color mode by providing a multi-color image forming apparatus with means for exposing before charging so that said means may be always operated in the mono-color mode before the image exposure and in the multi-color mode only before the formation of a latent image of a first color, in which no toner image is formed yet on an image retainer.

Moreover, the formation of the latent image (i.e., the image exposure) is accompanied by a problem that the optical fatigue of the image retainer differs between the states with and without the exposure before charging so that a potential difference is caused as the potential of a developed portion to fluctuate the image.

In order to solve the above-described problems, another object of the present invention is to provide an image forming apparatus which can make the potentials uniform thereby to eliminate the image fluctuations by making the grid voltage of a scorotron different between the portions having or not having been subjected to the exposure before charging.

According to the present invention, there is provided an image forming apparatus which can select between a case (i.e., the multi-color mode), in which a multi-color image is to be formed by repeating a series of primary charging, image exposing and developing steps for an image retainer to form a plurality of color toner images on a surface of the image retainer and by transferring the color toner images to a transfer material; and a case (i.e., the mono-color mode), in which a mono-color image is formed by a single sequence of the aforementioned steps to form a mono-color toner image and by transferring the mono-color toner image to a transfer material.

According to the present invention, there is provided an image forming apparatus which comprises means for exposing uniformly an image retainer before charging it primary, control means for controlling such that the exposure before charging is accomplished always in a mono-color mode and is accomplished only before the formation of a latent image of a first color in a multi-color mode; and charging device control means for controlling a grid voltage of a charging device in response to the start and stop of said exposure before charging.

In the mono-color mode, the mono-color image may be formed by developing toners of two or more colors at a single step to superpose a plurality of toners thereby to form a mono-color toner image and by transferring the mono-color toner image to a transfer material.

The image forming apparatus of the present invention is equipped with means for exposing before charging means, but this means is not operated at all times. In the present invention, the control means controls such that at least a region of the image retainer to be formed with a (latent) image is subjected continuously, in a mono-color mode, to the exposure before charging prior to each of charging and image exposing steps and such that at least the region of the image retainer to be formed with the (latent) image is subjected, in a multi-color mode, to the exposure before charging prior to the charging and image exposing steps for a first color but not for a second or subsequent colors.

As a result, it is possible to eliminate the ghost image, which is liable to form in the case of continuous formation of different images or especially in the case the demand system is adopted in the mono-color mode, and to overcome the problem of toner scattering in the multi-color mode. Incidentally in the mono-color mode, a mono-color image may be formed not only by the development with one kind of toner but also by mixing developing identical latent images with two kinds of toners to form a mixed mono-color image. In this case, too, the exposure before charging is accomplished prior to each of the charging and image exposing steps as in the case of the toner of only one kind.

In a more preferable mode of embodiment, in which the charging device control means is provided for controlling the grid voltage of a charging device by turning on and off the exposure before charging, it is possible to set the grid voltage of the charging device at a high level, for example, when a portion having been subjected to the exposure before charging passes under the charging device, and at a lower level, for example, when a portion not having been subjected to the exposure passes under the charging device. By setting the voltage at a proper level, moreover, it is possible to prevent generations of the potential difference due to the difference in the optical fatigue of the image retainer between with or without the exposure before charging and accordingly the image fluctuations.

Other objects and features of the present invention will become apparent from the following description to be made with reference to the accompanying drawings

DESCRIPTION OF THE PREFERRED EMBODIMENTS

Figure 1:
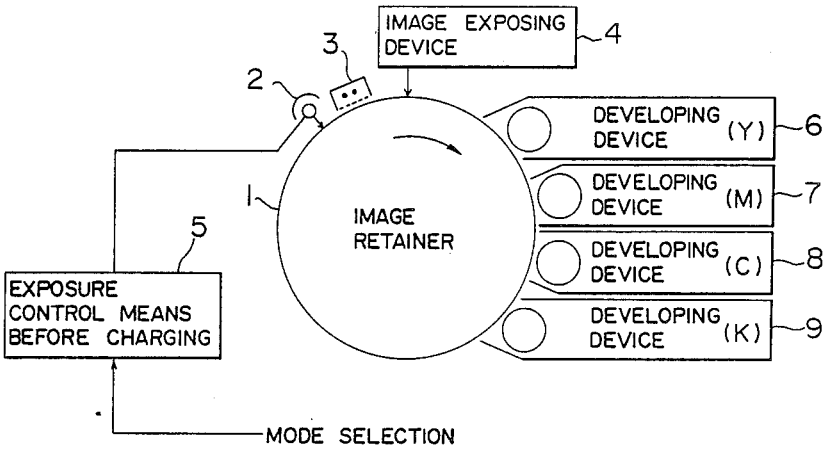
FIG. 1 is a diagram showing the major configuration of an embodiment of the present invention.

FIG. 1 is a diagram showing the major configuration of an image forming apparatus according to an embodiment of the present invention.

An image retainer 1 is uniformly charged, while being rotated in the direction of an arrow, by a charging device 3, and is subjected to an image exposure by an image exposing device 4 until it is provided with a latent image. In the multi-color mode, this latent image formation is accomplished for each of the color component separated, e.g., for each of the image signal of blue, green, red and black. If a latent image is formed in response to a color image signal of a first color, a toner image is formed on the image retainer by a developing device storing the toner of a color corresponding to a first color. The toner image is uniformly charged, after one rotation of the image retainer, by the charging device 3. The toner image of the first color is then covered with a latent image in response to a color image signal of a second color. On this latent image, there is superposed a toner image by a developing device storing a toner of a corresponding color. These steps are repeated to form a multi-color toner image on the image retainer 1. This multi-color image is collectively transferred to a transfer material to form a multi-color image. In the mono-color mode, a single formation of the latent image and the development with the toner of a desired color are accomplished, and the developed image is transferred to the transfer material to be fixed. Alternatively, identical latent images are developed with two kinds of toners of different colors to superpose the toner images of the two colors. These two toner images are transferred and are melted and mixed, when they are to be fixed, to form an image of a single intermediate color.

Means for exposing before charging to be used in the present invention is exemplified by a fluorescent discharge lamp such as a cold cathode ray tube or a neon tube, a tungsten lamp or an LED and is disposed upstream of the charging device 3 with respect to the rotational direction of the image retainer 1.

A cold cathode ray tube for emitting a green light is used in the present embodiment. Said means 2 is so controlled by control means 5 as to effect the exposure always prior to the image exposure in the mono-color mode and only prior to the formation of the latent image of a first color in the multi-color mode.

Figure 2:
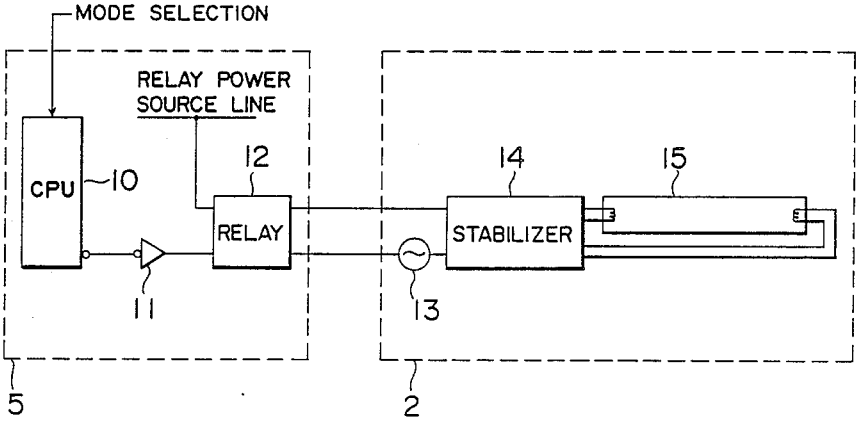
FIG. 2 is a diagram showing the specific configurations of exposure means and control means of the embodiment of FIG. 1.

FIG. 2 is a diagram showing the specific examples of the configurations of said means 2 using a fluorescent discharge lamp and means 5 for controlling said means 2.

The control means 5 is composed of a CPU 10, an inverter 11 and a relay 12 and is operative to control a control signal predetermined in each mode from the CPU 10 if a mode selecting signal is inputted to the CPU 10. The inverter 11 transforms this control signal into a drive signal for driving the relay 12 and feeds it to the relay 12.

This relay 12 turns on and off a current to be fed from a fluorescent discharge lamp power source 13 to a fluorescent discharge lamp 15 acting as an exposure light source. The exposure means 2 is composed of the fluorescent discharge lamp power source 13, a fluorescent discharge lamp stabilizer 14 and the fluorescent discharge lamp 15. In response to the on/off operation of the relay 12, moreover, the electric power is fed or not fed from the fluorescent discharge lamp power source 13 through the fluorescent discharge lamp stabilizer 14 to the fluorescent discharge lamp 15.

Figure 3:
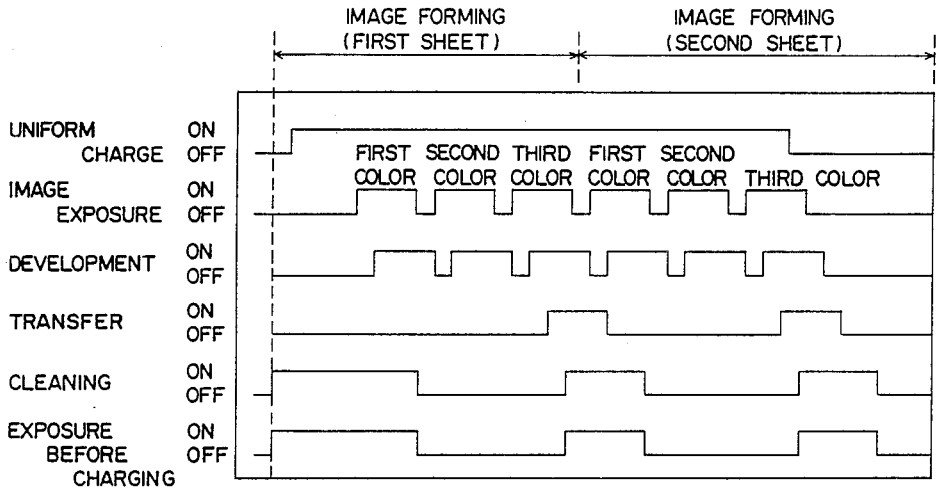
FIG. 3 is a time chart for explaining the operations of the individual steps of a two continuous reproductions in a multi-color mode.
Figure 4:
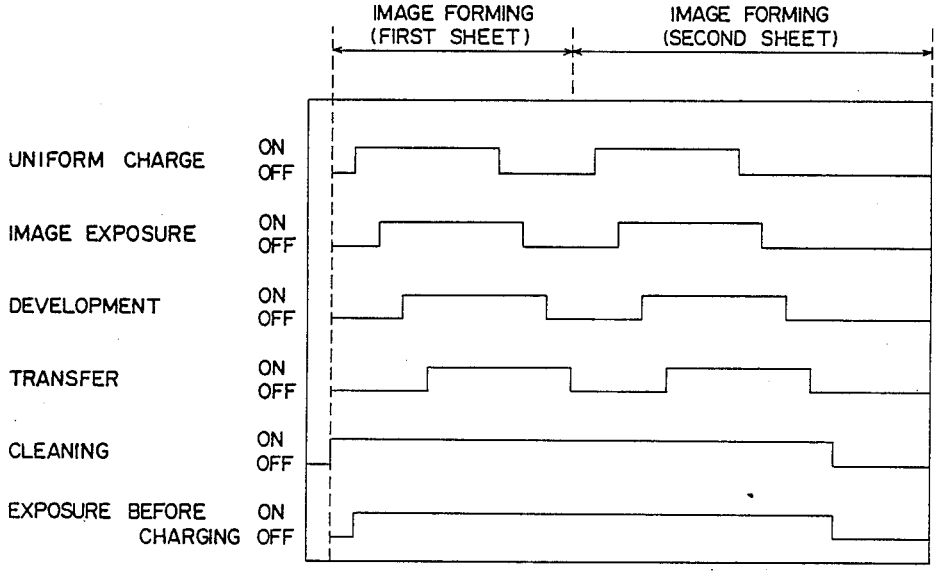
FIG. 4 is a time chart for explaining the operations of the individual steps of the two continuous reproductions in a mono-color mode with only one kind of toner.
Figure 5:
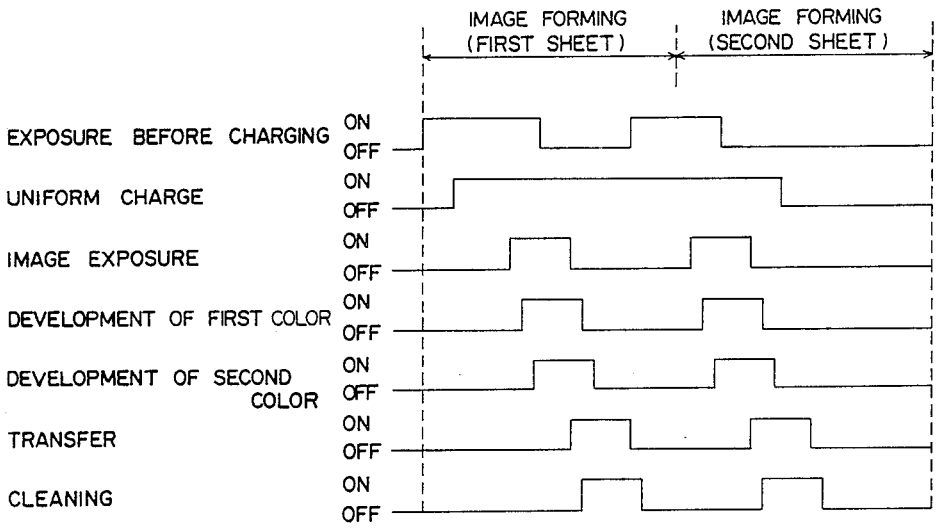
FIG. 5 is a time chart for explaining the operations of the individual steps of the two continuous reproductions in a mono-color mode with two kinds of toners mixed.

The exposure having its on-off operation controlled is illustrated along the time flow in terms of the individual uniform charging, image exposure, development, transfer and cleaning steps, as shown in FIGS. 3 to 5.

FIGS. 3 to 5 show the cases of two continuous reproductions: FIG. 3 represents the case of the multi-color mode; FIG. 4 represents the case of the development with a toner of one kind of color in the mono-color mode; and FIG. 5 represents the single color in the mono-color mode, in which identical latent images are developed with toners of two different kinds of colors into a mixed single color. In the mono-color mode of FIG. 5, there is shown an example in which only the region to be formed with the image (i.e., a region having a slight allowance for the image formed region) is irradiated with the exposure means In the case of the continuous reproductions, however, the exposure means can be kept lit at all times as in the case of FIG. 4.

Figure 6A:
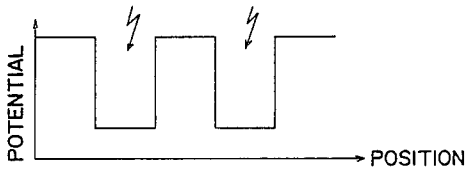
FIGS. 6A to 6C are diagrams for explaining the surface potentials of the image retainer in a two-color development mono-color mode.
Figure 6B:
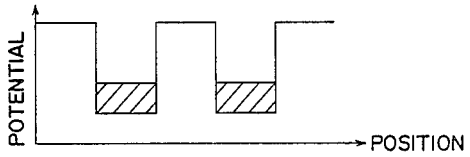
Figure 6C:
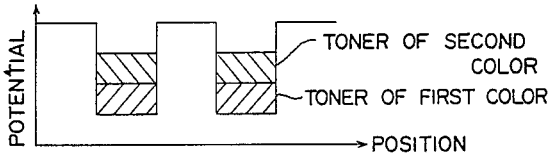
Figure 7A:
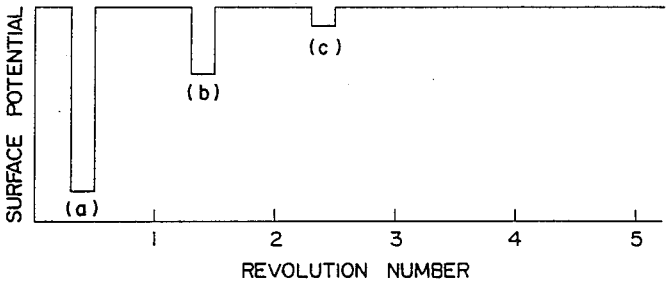
FIGS. 7A to 7C are diagrams for explaining the surface potentials of the image retainer.
Figure 7B:
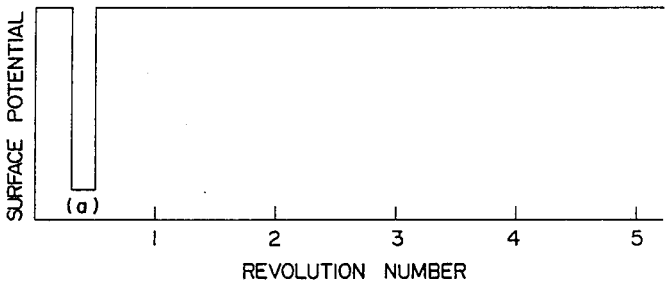
Figure 7C:
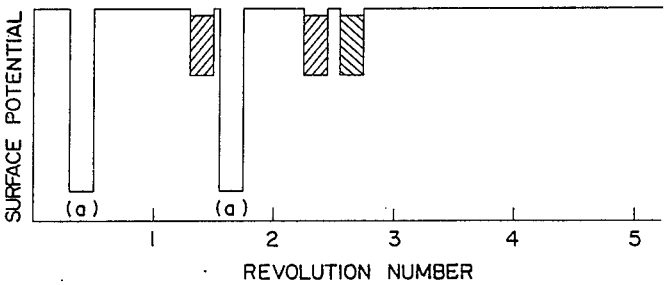

FIGS. 6A to 6C are diagrams showing the surface potentials of the image retainer when identical latent images are to be developed with two kinds of toners of different colors.

FIG. 6A shows a state in which the potential of a portion exposed to the image exposure light drops to form a latent image.

FIG. 6B shows a state in which the development is accomplished with the toner of a first color to raise the potential. The hatching indicates the potential rise due to the sticking of the toner.

FIG. 6C shows that the toner of a second color sticks to further raise the potential only by the inverse hatching.

The exposure shown in FIG. 3 is ON only when it corresponds to the image exposure of the first color. In FIG. 4, the exposure is ON while the image formation continues. FIG. 5 shows that the exposure is accomplished for each image exposure at all times prior to the image exposure Incidentally, before the image formation is actually started after the copy button has been depressed, it is the current practice that the image retainer is subjected to a preliminary rotation (i.e., a prerotation). The following case is naturally included in the present invention; namely the exposure for uniformly exposing at least the image formed region is accomplished, either during the preliminary rotation prior to the charging and image exposure for the image formation for the first time, or continuously up to the charging and image exposure for the first image formation after the preliminary rotation.

Figure 8:
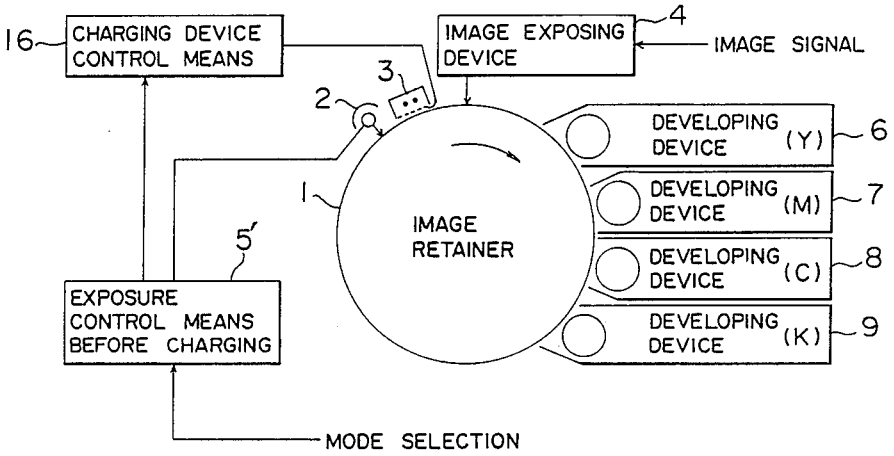
FIG. 8 is a diagram showing the major configuration of another embodiment of the present invention.

FIG. 8 is a diagram showing the major configuration of another embodiment in which means for controlling the voltage of the charging device is used in response to the ON and OFF of the exposure before charging.

In response to a signal from exposure control means 5', charging device control means 16 controls to switch the voltage to be applied to the grid of the charging device 3 between high and low levels depending on when the exposure before charging is effected or not.

Figure 9:
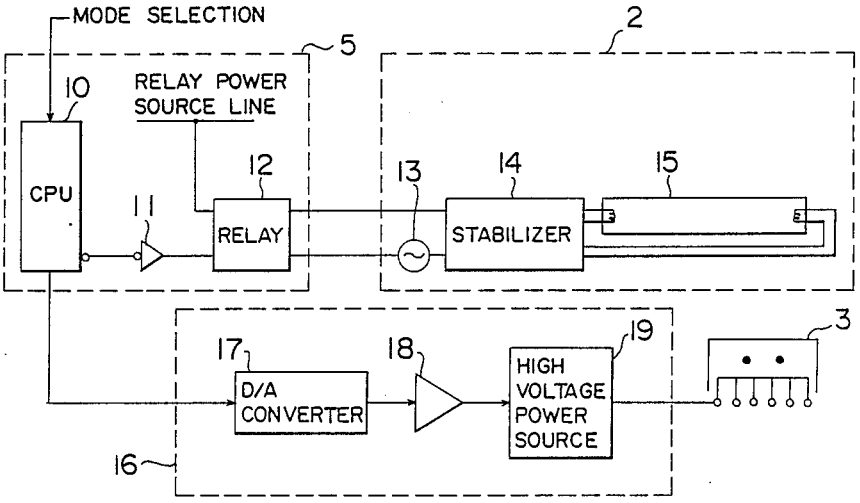
FIG. 9 is a diagram showing embodiments of the pre-charging exposure means and the control means for the charging device.

FIG. 9 is a diagram showing specific examples of the configurations of the exposure means 2, the exposure control means 5' and the charging device control means 16.

In response to a signal from a CPU 10', the charging device control means 16 performs a control to raise or lower the grid voltage of the charging device 3 in accordance with the on-off operation of the exposure means 2.

First of all, a digital signal from the CPU 10' is applied to a D/A converter 17 so that it is converted into an analog signal. This analog signal is obtained as a current signal and is converted by a current/voltage converting operation amplifier 18 into a voltage signal, which is then applied to a high-voltage power source 19. This power source 19 changes its output in accordance with its input voltage. This output of the power source 19 is applied to the grid of the charging device 3.

Figure 10:
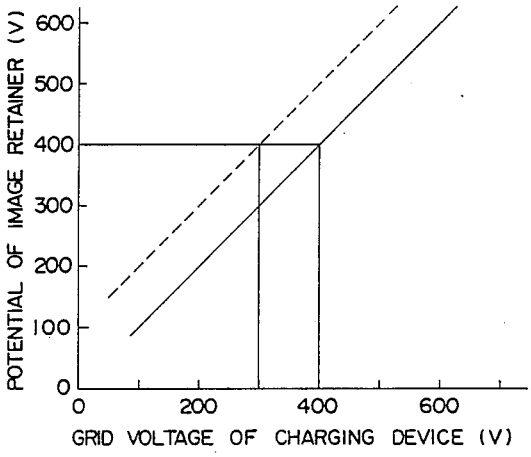
FIG. 10 is a characteristic curve plotting the potential of the image retainer against the grid voltage.

FIG. 10 is a diagram plotting an example of the relation between the voltage applied to the grid of the charging device 3 and the potential of the image retainer charged by the charging device 3. Their relation is generally linear, as is apparent from the diagram.

The image retainer has its potential changed when it is exposed. Now, if the potential drops upon an exposure, solid and broken lines in the shown example plot such relations between the grid voltage and the potential of the image retainer that correspond to the portions with and without the exposure, respectively. In this case, the potential of the image retainer charged can be made uniform (e.g., 400 V) irrespective of the on-off operation of the exposure by charging a portion subjected to exposure with a higher grid voltage (e.g., at 400 V) and a portion not subjected to it with a lower voltage (e.g., at 300 V).

Figure 11:
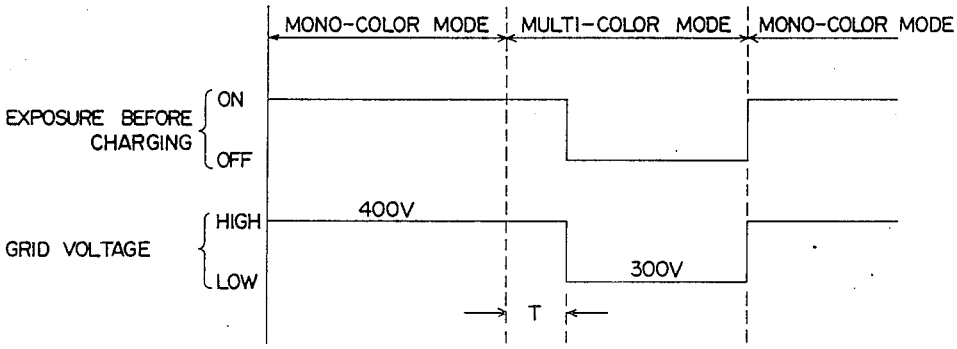
FIG. 11 is a chart showing the relation between pre-charging exposure and grid voltage.

FIG. 11 is a diagram showing the relations between the on-off operation of the exposure and the level of a grid voltage that make potential uniform after the charging operation. In the mono-color mode, the grid voltage is set at a high level (e.g., at 400 V) because the exposure is effected at all times. In the multi-color mode, on the other hand, a grid voltage is raised at a portion indicated by T in FIG. 10 because this portion has been subjected to exposure before the latent image formation of a first color, but it is lowered (e.g., to 300 V) after that because no exposure is then effected.

On the other hand, the aforementioned control of a grid voltage will be liable to invite a drop in the "chargeability", in which a sufficient potential cannot be attained at the initial stage of a charging operation after the image retainer (especially made of an organic photosensitive member) is left in the dark for a long time, even if charged by the charging device. In order to solve this problem, as shown in FIGS. 12A and 12B, the grid voltage of a scorotron is controlled at a higher level than a steady level until a predetermined number of reproductions are output after the image formation is started after a predetermined time period has elapsed since the stop of the image formation or after a main switch is turned on thus preventing the chargeability of the image retainer from dropping.

The drop of the chargeability is liable to occur, especially, in case that an organic photosensitive member is used as the image retainer.

Figure 12A:
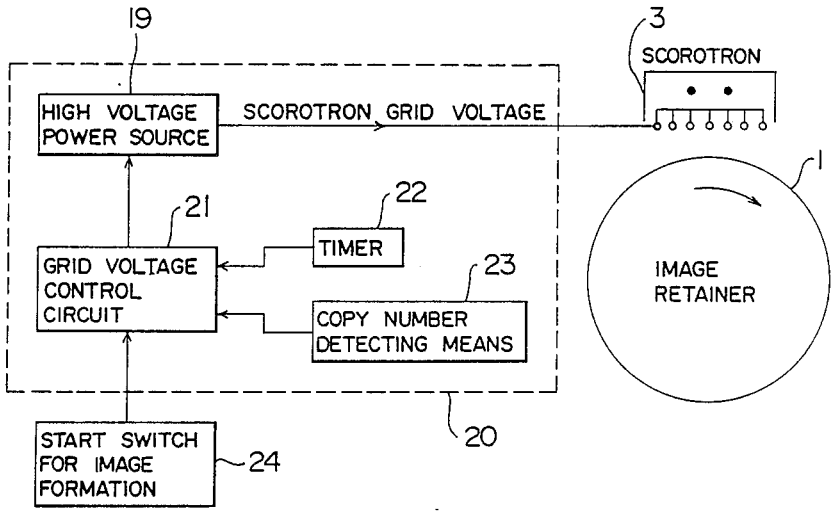
FIGS. 12A and 12B are diagrams showing other embodiments wherein the grid voltage is controlled.
Figure 12B:
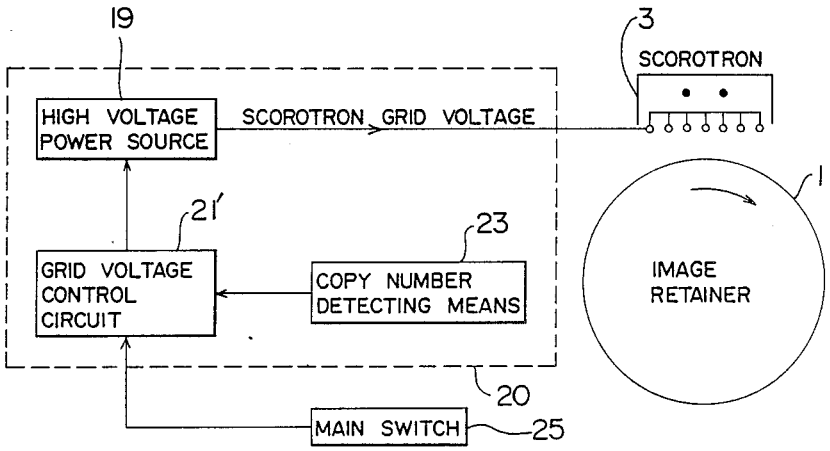

Grid voltage control means for preventing the drop of the chargeability of the image retainer shown in FIGS. 12A and 12B can be applied not only on the charging device of the present invention shown in FIG. 1 but also on the control means for the charging device shown in FIG. 8 by using OR circuit etc.

As has been described hereinbefore, the image forming apparatus according to the present invention comprises the exposure means; and the control means to control to effect the exposure at all times prior to the image exposure in a mono-color mode and only prior to the formation of a latent image of a first color in a multi-color mode. Thus, the present invention has an advantage that toner can be prevented from scattering in the multi-color mode and the ghost image can be prevented from being formed in both mono- and multi-color modes.

In addition, where a charging device control means is provided, the level of the grid voltage of the charging device is controlled in response to the on-off control of the exposure before charging. This makes it possible to prevent the potential of the image retainer after a primary charging operation from fluctuating in accordance with the on-off control of the exposure, thus providing another advantage that an image will not fluctuate even with the on-off control of the exposure. Development in the inventive apparatus is preferably carried out using a reversal developing method, although other conventional developing methods can be used therein.

What is claimed is:

1. An image forming apparatus comprising:

means for selecting a multi-color mode or a mono-color mode, wherein in multi-color mode a multi-color image is formed by repeating a series of uniform charging, image exposing and developing steps to form a plurality of color toner image on a surface of an image retainer, and transferring the color toner image to a transfer material, and wherein in mono-color mode a mono-color image is formed by uniform charging, image exposing and developing in a single step to form a mono-color toner image on the surface of the image retainer, and transferring the mono-color toner image to a transfer material, means for uniformly exposing the image retainer before the uniform charging step, and means for controlling said exposure means so that at least an image forming region on the image retainer is exposed by said exposing means in the mono-color mode, and the region is exposed by said exposing means for forming the first color toner image and said region is not exposed by said exposing means for forming second or subsequent toner image in multi-color mode, said apparatus further comprising means for controlling a grid voltage of a charging means during said uniform charging steps in response to an on/off control of said exposing means.

2. The image forming apparatus according to claim 1, wherein said mono-color image is formed by forming one color toner image on said surface of the image retainer by image exposing of one time and developing of one time after the uniform charging and transferring said one color toner image to the transfer material.

3. The image forming apparatus according to claim 1, wherein said mono-color image is formed by forming mono-color toner image superposed two or more kinds of color toner on said surface of the image retainer by image exposing of one time and developing of one time using two or more kinds of color toner after the uniform charging and transferring said superposed toner images to the transfer material.

4. The image forming apparatus according to claim 1, wherein said developing is a reversal developing.

5. The image forming apparatus according to claim 4, wherein said image retainer is an organic photosensitive member.

6. The image forming apparatus according to claim 1, wherein said image retainer is an organic photosensitive member.

7. The image forming apparatus according to claim 1, wherein said grid voltage controlling means controls such that the grid voltage is set at a high level when the exposing means is worked, and that the grid voltage is set at a low level when the exposing is not worked.

8. The image forming apparatus according to claim 1, wherein said developing is a reversal developing.

9. The image forming apparatus according to claim 1, wherein said image retainer is an organic photosensitive member.

* * * * *